US008186480B1

(12) United States Patent
Yoakum, Jr.

(10) Patent No.: US 8,186,480 B1
(45) Date of Patent: May 29, 2012

(54) MODULAR SCAFFOLD LADDER AND ASSOCIATED METHOD

(76) Inventor: Ruben Yoakum, Jr., La Marque, TX (US)

( * ) Notice: Subject to any disclaimer, the term of this patent is extended or adjusted under 35 U.S.C. 154(b) by 617 days.

(21) Appl. No.: 12/313,597

(22) Filed: Nov. 21, 2008

Related U.S. Application Data

(60) Provisional application No. 61/132,724, filed on Jun. 23, 2008.

(51) Int. Cl.
*E06C 1/30* (2006.01)

(52) U.S. Cl. ..... 182/118; 182/183.1; 182/129; 182/123

(58) Field of Classification Search ..... 182/223, 182/118, 119, 222, 183.1, 129
See application file for complete search history.

(56) References Cited

U.S. PATENT DOCUMENTS 402,175 A * 4/1889 Maurer ..... 182/183.1
3,997,024 A 12/1976 Fredricks
5,332,062 A 7/1994 Revere
5,746,288 A * 5/1998 O'Neal et al. ..... 182/118
5,988,317 A 11/1999 Riding

* cited by examiner

*Primary Examiner* — Katherine w Mitchell
*Assistant Examiner* — Daniel Cahn

(57) ABSTRACT

A multifunctional ladder for assisting a user to travel along a substantially vertical plane as well as a substantially horizontal plane respectively may include a telescopically adjustable walkway with a planar surface. Additionally, the ladder may include telescopically adjustable and independently detachable support legs connected to the walkway and extending downwardly therefrom. U-shaped brackets may also be affixed to ends of the walkway and a plurality of ladders may be pivotally coupled thereto. The ladders and support legs may maintain the walkway at a substantially stable position and the ladders may freely articulate about fulcrum pivot axes while the support legs and walkway remain at fixed and stationary positions. The walkway preferably has a male and a female member slidably engaged therewith for permitting adjustment of a longitudinal length of the walkway, and U-shaped rails directly coupled thereto for shielding a user from falling off of the walkway.

11 Claims, 4 Drawing Sheets

MODULAR SCAFFOLD LADDER AND ASSOCIATED METHOD

CROSS REFERENCE TO RELATED APPLICATIONS

This application claims the benefit of U.S. Provisional Application No. 61/132,724, filed Jun. 23, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to ladders and, more particularly, to a multifunctional ladder for assisting a user to travel along a substantially vertical plane as well as a substantially horizontal plane respectively.

PRIOR ART

Masonry and carpentry are two of many jobs that require the use of scaffolds. Scaffolds assist workers by allowing them to work in elevated positions. However, scaffolds have several challenges. Scaffolds must be transported to and from the workplace, and must be assembled and disassembled. Additionally, scaffolds must be stored when they are not in use. All of these activities require time, and these conditions are compounded when the work area is small and confined or when a scaffold is moved from location to location through narrow openings. Any time a scaffold is moved, whether it is from one workplace to another or simply to another location at the same workplace, an additional assembly and reassembly of the scaffold is required. With a conventional scaffold, the scaffold must be disassembled and then reassembled as the work location requires. The economic impact on the employer is profound, as the workers must be paid for their time. An employer would prefer to pay workers for work done on an employer's contractual obligations, rather than for time spent transporting, assembling, disassembling and storing scaffolds. Further, a project is delayed by the time workers spend transporting, assembling, disassembling and storing scaffolds. One significant advantage of conventional scaffolds is that they are rigid and enable workers to be securely supported.

U.S. Pat. No. 3,997,024 to Fredricks and Smith discloses a portable collapsible scaffold ladder with a pair of upright caster-mounted end members joined together by a horizontal platform member. A pull-out ladder for ascending to the platform is connectable at its upper end and slidable along its connected end member for movement between a nested position within that end member and a diagonally extending operative position. The platform member is joined to the two end members by T-shaped glide members pivoted to each of the four corners of the platform member. Each glide member has a glide portion slidable along one side of a connected end member and a pivot portion pivoted to an adjacent side portion of the platform member. Each glide member has a resilient leaf-type spring which carries two locking pins, one for interlocking with the platform and the other for interlocking with one of a series of pin-receiving openings in the upright. When the pins are engaged, the glide members rigidly interlock the platform member and two end members at right angles for use, or in parallel collapsed relationship for transport. When one pin of each pair of glide members is disengaged, the platform can be moved along the adjacent end member. When the opposite pin of each pair of glide members is disengaged, the platform and end members can be freely pivoted with respect to one another. Unfortunately, this prior art reference does not disclose ladders incorporated into the design of the upright end members.

U.S. Pat. No. 5,332,062 to Revere discloses a combination scaffold ladder device having a scaffold portion which is formed by a prop positioned above a pair of ladder side members, and is connected to the sides by connecting means which include a top step and a pair of extensible spreaders. The parallel ladder side members each contain at least one indentation, and are joined together by a plurality of ladder steps with two of the steps being partial in nature. The ladder structure and the prop in the horizontal position is supported by versatile support members that are attached near the top of the versatile support member housings to the parallel ladder side members by pivotable joint pins and locked into position by extensible spreaders. The vertical placement of the ladder structure away from the prop through the use of extensible spreaders affords the invention its stepladder configuration. Unfortunately, this prior art does not disclose a ladder that could raise the scaffold to various height levels.

U.S. Pat. No. 5,988,317 to Riding discloses a modular foldable scaffold with hinged structures that can be easily assembled, disassembled and compactly stored. The three main components of the scaffold are modular end ladders, a modular support platform and modular stabilizing members. A clamping assembly at each end of the stabilizing members can be set to permit the pivoting of the stabilizing members with respect to the end ladder legs, thus allowing the scaffold to adopt any one of a variety of collapsed configurations in which the scaffold can be relocated through narrow passages without having to disassemble it. Unfortunately, this prior art does not disclose a scaffold that is incorporated into the ladder design itself.

Accordingly, a need remains for a modular scaffold ladder in order to overcome the above-noted shortcomings. The present invention satisfies such a need by providing a device that is convenient and easy to use, is durable yet lightweight in design, is versatile in its applications, and provides a user with assistance traveling along a substantially vertical plane as well as a substantially horizontal plane respectively.

BRIEF SUMMARY OF THE INVENTION

In view of the foregoing background, it is therefore an object of the present invention to provide an apparatus for assisting a user to travel along a substantially vertical plane as well as a substantially horizontal plane respectively. These and other objects, features, and advantages of the invention are provided by a modular scaffold ladder.

A multifunctional ladder for assisting a user to travel along a substantially vertical plane as well as a substantially horizontal plane respectively may include a telescopically adjustable walkway preferably having a planar surface defining a travel path along the substantially horizontal plane. By being telescopically adjustable, the walkway allows the user to selectively position the length of the pathway to fit the individual needs of the job without having to continuously move the ladder back and forth. Additionally, the multifunctional ladder may include a plurality of telescopically adjustable support legs directly connected to the walkway and extending downwardly therefrom.

Such support legs may rest on a ground surface respectively and may be registered parallel to a vertical plane. The support legs ensure the ladder remains steady during times of operation, effectively promoting safety for the user during unstable conditions or ground surfaces. The multifunctional ladder may also include a plurality of U-shaped brackets affixed directly to axially opposed ends of the walkway respectively. Further, a plurality of ladders may be included and pivotally coupled to the brackets respectively.

The multifunctional ladder may further include each of the ladders cooperating with the support legs for maintaining the walkway at a substantially stable position during operating conditions. In this manner, the ladders may be adjusted along with the support legs to further ensure the apparatus remains stable and safe for working conditions. In addition, each of the ladders may freely articulate about a corresponding fulcrum pivot axis while the support legs and the walkway remain at a fixed and stationary position. The fulcrum pivot axes may be registered orthogonal to the support legs. The ladders moving about the pivot axes allow the user to adjust the angle of the ladders for easier ascension or placement on uneven ground surfaces. Also as a vital element of the present invention, each of the support legs may be independently detachable from the walkway for permitting adjustment of a longitudinal length of the walkway. The support legs may quickly detach to lengthen the walkway and then reattach to stabilize the apparatus.

The multifunctional ladder may further include the walkway preferably having a male member and a female member slidably engaged therewith. Each of the male and female members may have a planar top surface oriented along the substantially horizontal plane. Additionally, the multifunctional ladder may include each of the brackets having a U-shaped rail directly and fixedly coupled thereto for shielding a user from falling off the opposed ends of the walkway during operating conditions. The U-shaped rails preferably extend upwardly from the brackets and may be registered parallel to the support legs respectively. As a user approaches the end of the walkway while working, they may brace themselves against the rails for safety purposes.

In addition, the multifunctional ladder may include each of the ladders preferably being pivotal along a mutually exclusive arcuate path defined at the opposed ends of the walkway respectively. The brackets and the U-shaped rails may also remain at stationary positions while the ladders are biased along the arcuate paths respectively. Further, each of the ladders may include a first section and a second section slidably connected therewith. This may operate to allow the user to adjust the height of each individual ladder to fit a desired angle or uneven ground surface, or adjust all ladders to raise or lower the height of the walkway.

The first section may be pivotally coupled directly to an associated one of the brackets and further may remain spaced above the ground surface. The second section may have a plurality of wheels coupled to a bottom thereof with the wheels remaining engaged with the ground surface during operating conditions. The wheels may further assist the user in repositioning the apparatus without the need of another person's help. The multifunctional ladder may further include each of the ladders diverging downwardly and away from the brackets. Additionally, each of the ladders may be angularly offset away from the support legs respectively, further establishing a stable base for the user to stand upon and complete work functions. The first and second sections of the ladders may also pivot in sync while the support legs remain statically engaged with the walkway.

The present invention may further include a method for assisting a user to travel along a substantially vertical plane as well as a substantially horizontal plane respectively. Such a method may include the chronological steps of first providing a telescopically adjustable walkway preferably having a planar surface defining a travel path along the substantially horizontal plane. A second step of the method may include providing and directly connecting a plurality of telescopically adjustable support legs to the walkway such that the support legs extend downwardly from the walkway.

Third, the method may include resting the support legs on a ground surface while registering the support legs parallel to a vertical plane. Fourth, the method may include providing a plurality of U-shaped brackets affixed directly to axially opposed ends of the walkway respectively. Next, the method may include providing and pivotally coupling a plurality of ladders to the brackets respectively. Finally, a sixth step may include freely articulating each of the ladders about a corresponding fulcrum pivot axis while the support legs and the walkway remain at a fixed and stationary position. Each of the ladders may cooperate with the support legs for maintaining the walkway at a substantially stable position during operating conditions. Additionally, the fulcrum pivot axes may be registered orthogonal to the support legs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
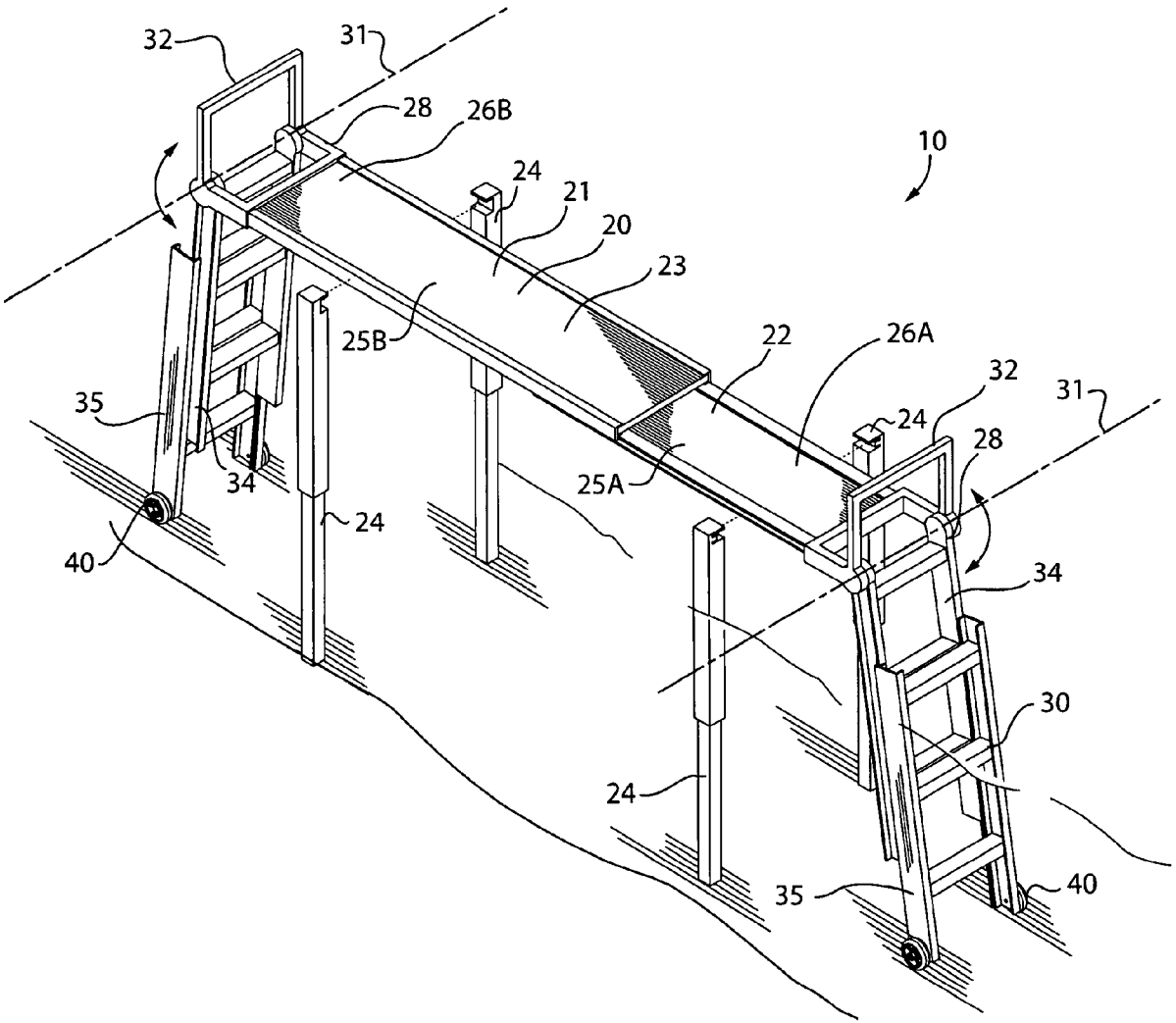
FIG. 1 is a perspective view showing a multifunctional ladder with removably attached adjustable support legs, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a multifunctional ladder. It should be understood that the multifunctional ladder 10 may be used to assist users in traveling along vertical and horizontal planes of many different heights and for a variety of purposes, including for private or commercial purposes, and should not be limited to the applications discussed herein.

Referring to FIGS. 1-4 in general, a multifunctional ladder 10 for assisting a user to travel along a substantially vertical plane as well as a substantially horizontal plane respectively may include a telescopically adjustable walkway 20 preferably having a planar surface 21 defining a travel path along the substantially horizontal plane. By being telescopically adjustable, the walkway 20 allows the user to selectively position the length of the pathway to fit the individual needs of the job without having to continuously move the ladder 10 back and forth. Additionally, the multifunctional ladder 10 may include a plurality of telescopically adjustable support legs 24 directly connected to the walkway 20 and extending downwardly therefrom. Such support legs 24 may rest on a ground surface respectively and may be registered parallel to a vertical plane.

The support legs 24 are vital and advantageous in that they ensure the ladder 10 remains steady during times of operation, effectively promoting safety for the user during unstable conditions or uneven ground surfaces. The multifunctional ladder 10 may also include a plurality of U-shaped brackets 28 affixed directly to axially opposed ends 26A, 26B of the walkway 20 respectively. Further, a plurality of ladders 30 may be included and pivotally coupled to the brackets 28 respectively.

Figure 3:
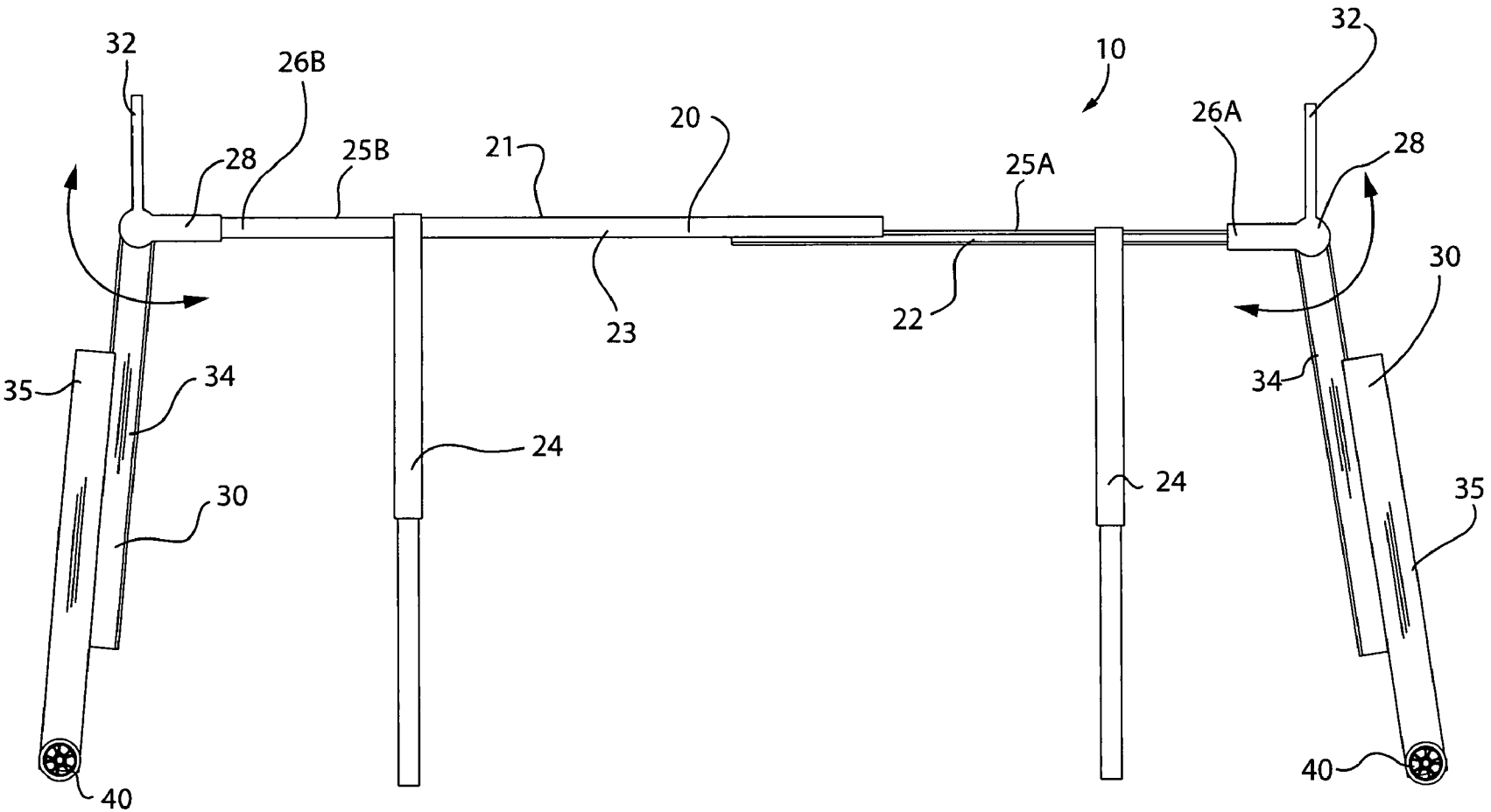
FIG. 3 is a side elevational view of the multifunctional ladder of FIG. 1, showing the pivotal movement of the ladders about the fulcrum axis.
Figure 4:
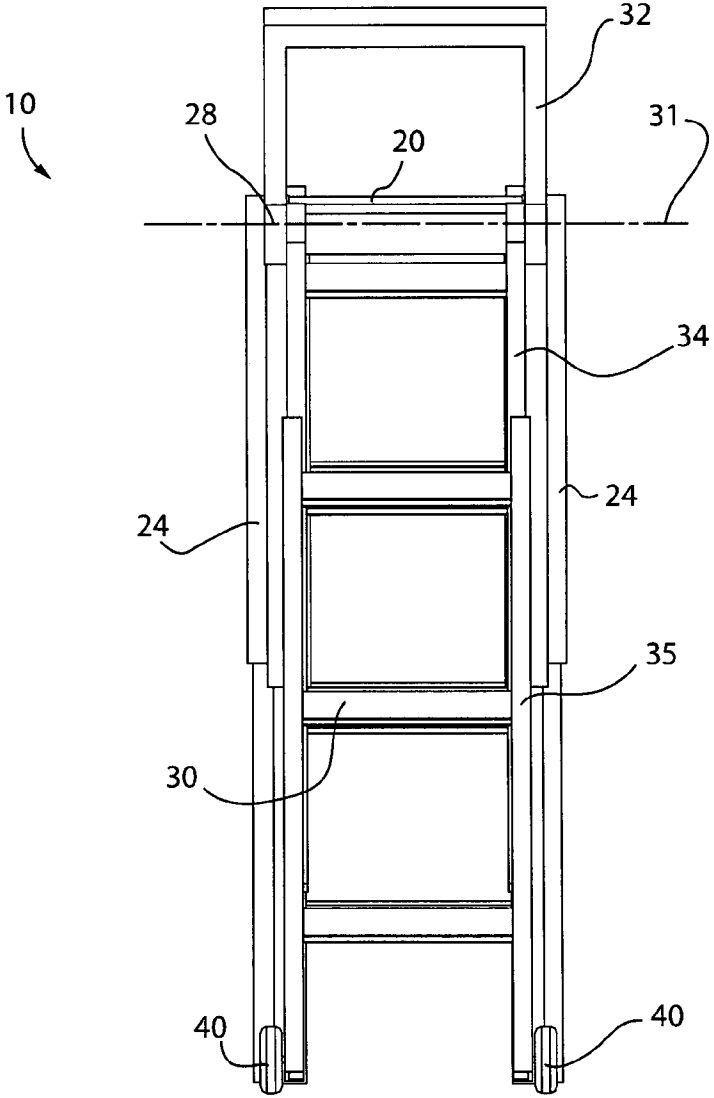
FIG. 4 is a front elevational view of the multifunctional ladder of FIG. 1.

Referring specifically to FIGS. 1 and 3, the multifunctional ladder 10 may further include each of the ladders 30 cooperating with the support legs 24 for maintaining the walkway 20 at a substantially stable position during operating conditions. In this manner, the ladders 30 may be adjusted along with the support legs 24 to further ensure the apparatus 10 remains stable and safe for working conditions. In addition, each of the ladders 30 may freely articulate about a corresponding fulcrum pivot axis 31 while the support legs 24 and the walkway 20 remain at a fixed and stationary position. The fulcrum pivot axes 31 may be registered orthogonal to the support legs 24.

The ladders 30 moving about the pivot axes 31 allow the user to adjust the angle of the ladders 30 for easier ascension by the user or placement on uneven ground surfaces. Also, as a vital element of the present invention 10, each of the support legs 24 may be independently detachable from the walkway 20 for permitting adjustment of a longitudinal length of the walkway 20. The support legs 24 may quickly detach to lengthen the walkway 20 and then reattach to stabilize the apparatus 10.

Referring again to FIGS. 1-4, the multifunctional ladder 10 may further include the walkway 20 preferably having a male member 22 and a female member 23 slidably engaged therewith. Each of the male 22 and female 23 members may have a planar top surface 25A, 25B oriented along the substantially horizontal plane. Additionally, the multifunctional ladder 10 may include each of the brackets 28 having a U-shaped rail 32 directly and fixedly coupled thereto for shielding a user from falling off the opposed ends 26A, 26B of the walkway 20 during operating conditions. The U-shaped rails 32 preferably extend upwardly from the brackets 28 and may be registered parallel to the support legs 24 respectively. The rails 32 are advantageous in that as a user approaches the end of the walkway 20 while working, the user may brace themselves against the rails 32 for safety purposes.

Additionally referring to FIGS. 1-4, the multifunctional ladder 10 may include each of the ladders 30 preferably being pivotal along a mutually exclusive arcuate path defined at the opposed ends 26A, 26B of the walkway 20 respectively. The brackets 28 and the U-shaped rails 32 may also'remain at stationary positions while the ladders 30 are biased along the arcuate paths respectively. Further, each of the ladders 30 may include a first section 34 and a second section 35 slidably connected therewith.

The present invention, as claimed, provides the unexpected and unpredictable benefit of operating to allow a user to adjust the height of each individual ladder 30 to fit a desired angle or uneven ground surface, or adjust all ladders 30 to raise or lower the height of the walkway 20. The first section 34 may be pivotally coupled directly to an associated one of the brackets 28 and further may remain spaced above the ground surface. The second section 35 may have a plurality of wheels 40 coupled to a bottom thereof with the wheels 40 remaining engaged with the ground surface during operating conditions. The wheels 40 are advantageous in that they may further assist the user in repositioning the apparatus 10 without the need of another person's help.

Figure 2:
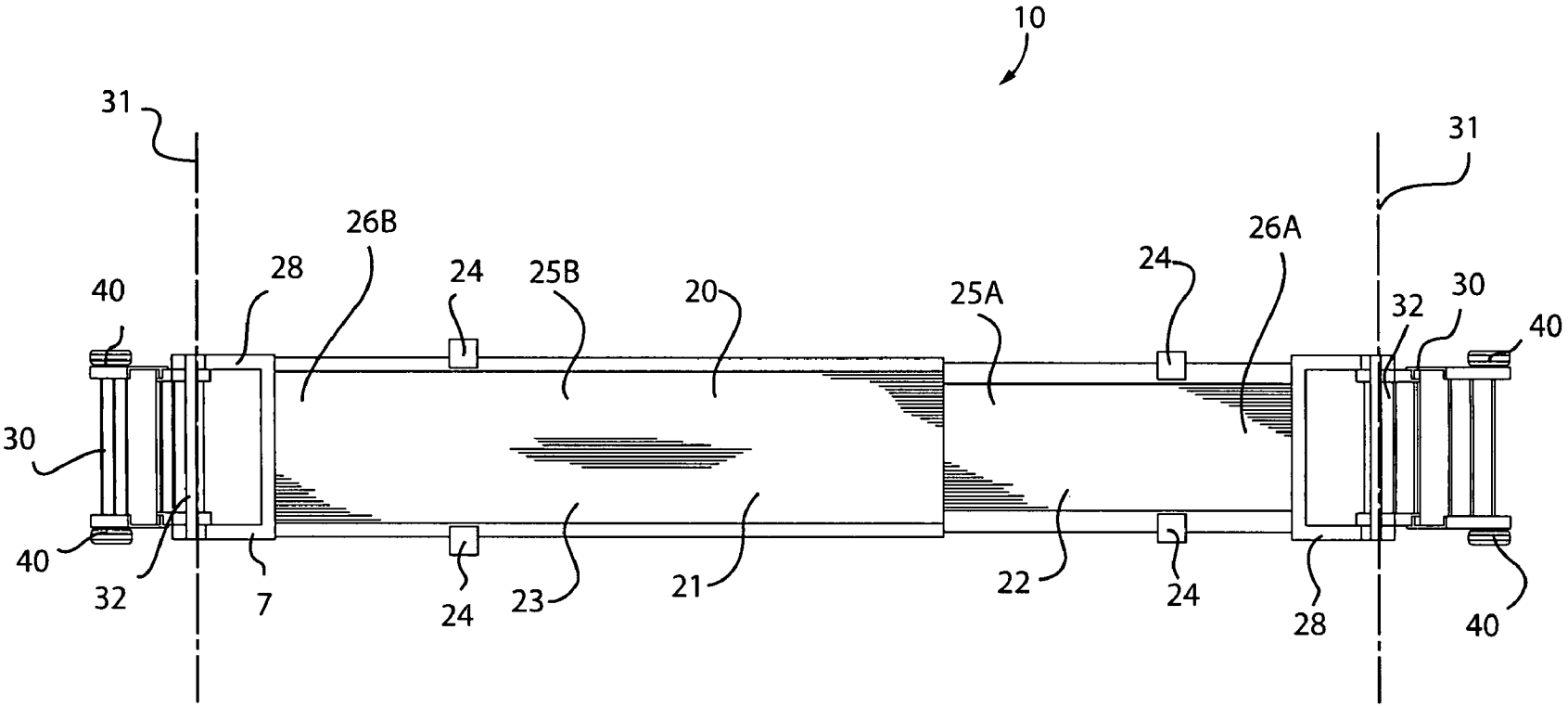
FIG. 2 is a top plan view of the multifunctional ladder of FIG. 1.

Referring specifically to FIGS. 1-3, the multifunctional ladder 10 may further include each of the ladders 30 diverging downwardly and away from the brackets 28. Additionally, each of the ladders 30 may be angularly offset away from the support legs 24 respectively, further establishing a stable base for the user to stand upon and complete work functions. The first 34 and second 35 sections of the ladders 30 may also pivot in sync while the support legs 24 remain statically engaged with the walkway 20. The combination of the ladders 30 with the support legs 24 provides an unpredictable and unexpected result of an easily ascendable elevated work platform that is also substantially stable for safety purposes and is not rendered obvious by one skilled in the art.

Again referring to FIGS. 1-4 in general, the present invention 10 may further include a method for assisting a user to travel along a substantially vertical plane as well as a substantially horizontal plane respectively. Such a method may include the chronological steps of first providing a telescopically adjustable walkway 20 preferably having a planar surface 21 defining a travel path along the substantially horizontal plane. A second step of the method may include providing and directly connecting a plurality of telescopically adjustable support legs 24 to the walkway 20 such that the support legs 24 extend downwardly from the walkway 20. Third, the method may include resting the support legs 24 on a ground surface while registering the support legs 24 parallel to a vertical plane. Fourth, the method may include providing and affixing a plurality of U-shaped brackets 28 directly to axially opposed ends 26A, 26B of the walkway 20 respectively.

Next, the method may include providing and pivotally coupling a plurality of ladders 30 to the brackets 28 respectively. Finally, a sixth step may include freely articulating each of the ladders 30 about a corresponding fulcrum pivot axis 31 while the support legs 24 and the walkway 20 remain at a fixed and stationary position. Each of the ladders 30 may cooperate with the support legs 24 for maintaining the walkway 20 at a substantially stable position during operating conditions. Additionally, the fulcrum pivot axes 31 may be registered orthogonal to the support legs 24. The described method along with the multifunctional ladder 10, as claimed, provides the unexpected and unpredictable benefit of allowing a user to easily access and work at a variety of elevated planes. Such a combination of claimed elements is further advantageous for promoting the safety of the user by stabilizing the elevated plane during work conditions, a result not rendered obvious by one skilled in the art.

In an alternate embodiment, the apparatus 10 may include the telescopically adjustable support legs 24 being removably attached by way of a pivotal hinge bracket that may allow the support legs 24 to fold up against the adjustable walkway 20 when not in use. Such a bracket may also allow the support legs 24 to extend downwardly and away from the walkway 20 at a desirable angle for providing further stabilization of the elevated walkway 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multifunctional ladder for assisting a user to travel along a substantially vertical plane as well as a substantially horizontal plane respectively, said multifunctional ladder comprising:

a telescopically adjustable walkway having a planar surface defining a travel path along the substantially horizontal plane;

a plurality of telescopically adjustable support legs directly connected to said walkway and extending downwardly therefrom, said support legs being registered parallel to a vertical plane;

a plurality of U-shaped brackets affixed directly to axially opposed ends of said walkway respectively; and a plurality of ladders pivotally coupled to said brackets respectively;

wherein each of said ladders is freely articulated about a corresponding fulcrum pivot axis independently of telescopic movement of said support legs and said walkway respectively;

wherein each said fulcrum axis and said walkway are coplanar; and wherein each of said support legs is independently detachable from said walkway for permitting adjustment of a longitudinal length of said walkway; and wherein said walkway comprises a male member and a female member slidably engaged therewith, each of said male and female members having a planar top surface oriented along the substantially horizontal plane; and wherein each of said brackets respectively comprise:

a first U-shaped rail directly coupled to said walkway and a second U-shaped rail directly coupled to said first U-shaped rail, said second U-shaped rail registered parallel to said support legs and said first U-shaped rail being registered parallel to said walkway, wherein said second U-shaped rail is registered orthogonal to said first U-shaped rail.

2. The multifunctional ladder of claim 1, wherein each of said ladders is pivotal along a mutually exclusive arcuate path defined at said opposed ends of said walkway respectively, said U-shaped rails remaining at stationary positions while said ladders are pivoted along said arcuate paths respectively.

3. The multifunctional ladder of claim 1, wherein each of said ladders comprises:

a first section and a second section slidably connected to said first section, said first section being pivotally coupled directly to an associated one of said brackets, said second section having a plurality of wheels coupled to a bottom thereof.

4. The multifunctional ladder of claim 1, wherein each of said ladders diverge downwardly and away from said brackets, each of said ladders being angularly offset away from said support legs respectively.

5. The multifunctional ladder of claim 3, wherein said first and second sections of said ladders pivot in sync while said support legs remain statically engaged with said walkway.

6. A multifunctional ladder for assisting a user to travel along a substantially vertical plane as well as a substantially horizontal plane respectively, said multifunctional ladder comprising:

a telescopically adjustable walkway having a planar surface defining a travel path along the substantially horizontal plane;

a plurality of telescopically adjustable support legs directly connected to said walkway and extending downwardly therefrom, said support legs being registered parallel to a vertical plane;

a plurality of U-shaped brackets affixed directly to axially opposed ends of said walkway respectively; and a plurality of ladders pivotally coupled to said brackets respectively;

wherein each of said ladders is freely articulated about a corresponding fulcrum pivot axis independently of telescopic movement of said support legs and said walkway respectively;

wherein said fulcrum pivot axes are registered orthogonal to said support legs, and said fulcrum pivot axes and said walkway are coplanar;

wherein said walkway comprises a male member and a female member slidably engaged therewith, each of said male and female members having a planar top surface oriented along the substantially horizontal plane;

wherein first and second ones of said support legs are removably attached to opposed longitudinal edges of said male member respectively;

wherein third and fourth ones of said support legs are removably attached to opposed longitudinal edges of said female member respectively;

wherein each of said brackets respectively comprise:

a first U-shaped rail directly coupled to said walkway and a second U-shaped rail directly coupled to said first U-shaped rail, said second U-shaped rail registered parallel to said support legs and said first U-shaped rail being registered parallel to said walkway, wherein said second U-shaped rail is registered orthogonal to said first U-shaped rail.

7. The multifunctional ladder of claim 6, wherein each of said support legs is independently detachable from said walkway for permitting adjustment of a longitudinal length of said walkway.

8. The multifunctional ladder of claim 1, wherein each of said ladders is pivotal along a mutually exclusive arcuate path defined at said opposed ends of said walkway respectively, said U-shaped rails remaining at stationary positions while said ladders are pivoted along said arcuate paths respectively.

9. The multifunctional ladder of claim 6, wherein each of said ladders comprises:

a first section and a second section slidably connected to said first section, said first section being pivotally coupled directly to an associated one of said brackets, said second section having a plurality of wheels coupled to a bottom thereof.

10. The multifunctional ladder of claim 6, wherein each of said ladders diverge downwardly and away from said brackets, each of said ladders being angularly offset away from said support legs respectively.

11. The multifunctional ladder of claim 9, wherein said first and second sections of said ladders pivot in sync while said support legs remain statically engaged with said walkway.

* * * * *